US006302289B1

(12) United States Patent
Andersson et al.

(10) Patent No.: US 6,302,289 B1
(45) Date of Patent: Oct. 16, 2001

(54) SAFETY DEVICE IN OPENING ARRANGEMENTS FOR PACKAGING CONTAINERS

(75) Inventors: Ingvar Andersson; Thomas Pettersson, both of Löddeköpinge; Peter Öhman, Lund; Göran Helldin, Götene, all of (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/477,367

(22) Filed: Jan. 4, 2000

(30) Foreign Application Priority Data

Jan. 7, 1999 (SE) ..... 9900017

(51) Int. Cl.[7] ..... B65D 51/00
(52) U.S. Cl. ..... 220/256; 220/345.1; 215/215
(58) Field of Search ..... 220/256, 253, 220/345.1, 729; 215/250

(56) References Cited

U.S. PATENT DOCUMENTS

| | | | | |
|---|---|---|---|---|
| 3,363,798 | * | 1/1968 | Garangiotis . | |
| 4,003,493 | * | 1/1977 | Wells et al. | 220/267 |
| 4,438,864 | * | 3/1984 | Helms | 215/250 X |
| 4,444,328 | | 4/1984 | Glass | 215/230 |
| 4,458,820 | | 7/1984 | Abrams | 215/230 |
| 4,570,817 | * | 2/1986 | Hambleton et al. | 220/345.1 |
| 4,588,098 | | 5/1986 | Uzdy | 215/230 |
| 4,598,837 | * | 7/1986 | Kreiseder et al. | 220/253 |
| 4,646,926 | * | 3/1987 | Agbay et al. | 215/250 X |
| 4,674,641 | | 6/1987 | Rusinyak | 215/230 |
| 4,778,069 | * | 10/1988 | Keller | 215/250 X |
| 5,090,584 | * | 2/1992 | Robert et al. | 220/712 |
| 5,477,972 | | 12/1995 | Lester | 215/230 |
| 5,692,633 | * | 12/1997 | Gordon | 220/253 |
| 5,755,345 | | 5/1998 | Valyi | 215/250 |
| 6,050,436 | * | 4/2000 | Bennett et al. | 220/256 X |

FOREIGN PATENT DOCUMENTS

| | | |
|---|---|---|
| 0 280 023 A2 | 8/1988 | (EP) . |
| WO 97/38910 | 10/1997 | (WO) . |

* cited by examiner

*Primary Examiner*—Steven Pollard
(74) *Attorney, Agent, or Firm*—Burns, Doane, Swecker & Mathis, L.L.P.

(57) ABSTRACT

The disclosure relates to a safety device in an opening arrangement for packaging containers, the opening arrangement having a part fixedly connected to the packaging container and a lid portion displaceable in relation thereto. In the closed position of the opening arrangement, a tongue-shaped projection (9) extends via a slit (15) into a recess (14) in the openable part. The projection (9) will thus be partly visible from the upper side of the opening arrangement until such time as the moving part (4) has been displaced to an open position in which the projection (9) irreversibly departs from the recess (14) and gives a clear, visual indication that the opening arrangement has previously been opened.

9 Claims, 2 Drawing Sheets

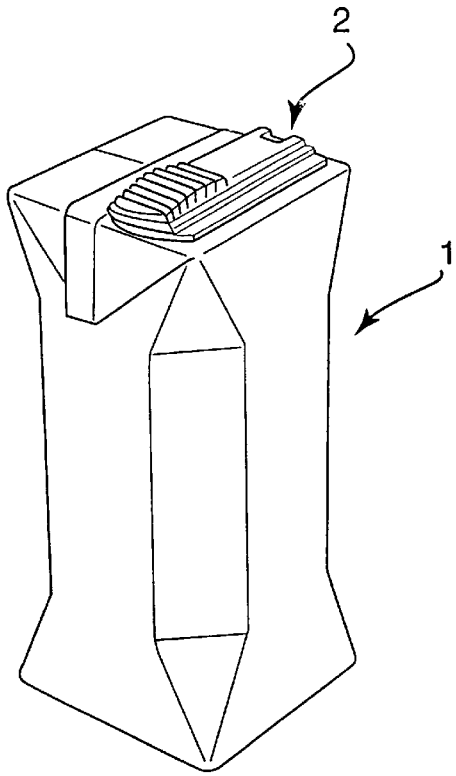
Fig 1
Fig 2A
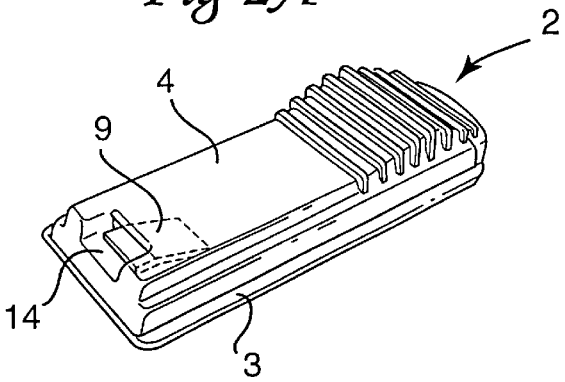
Fig 2B
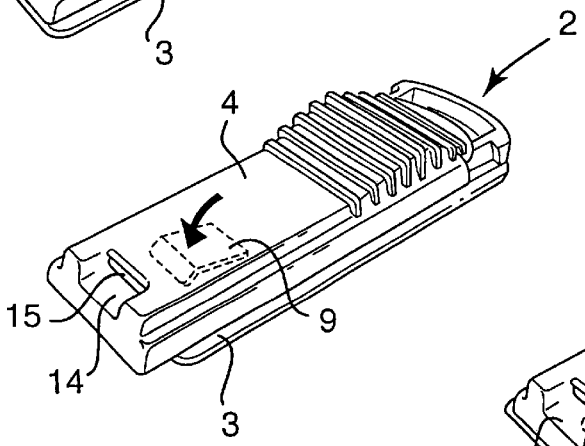
Fig 2C
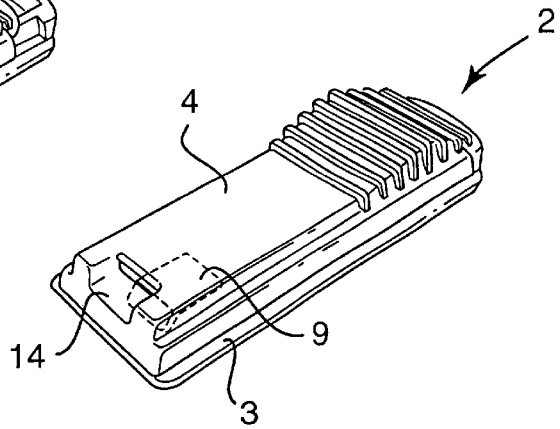

Fig 3A
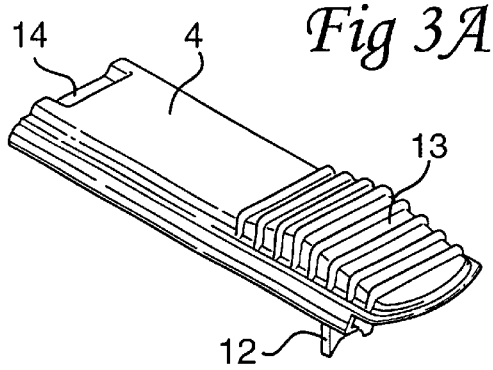
Fig 3B
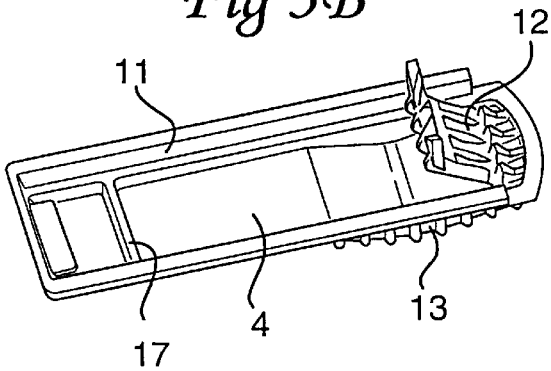
Fig 4A
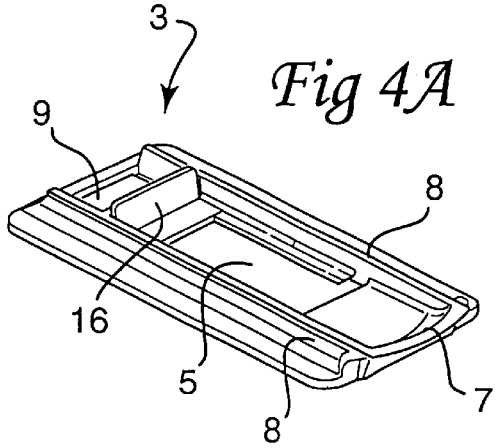
Fig 4B
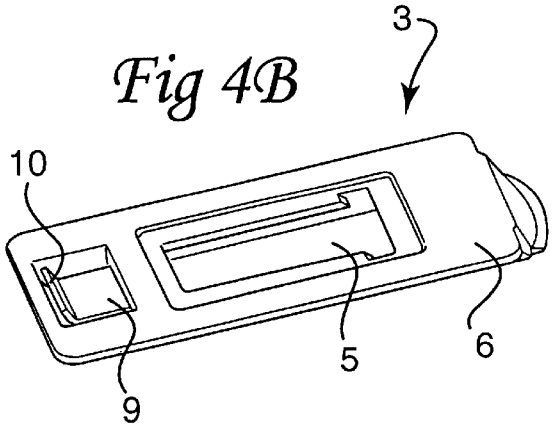
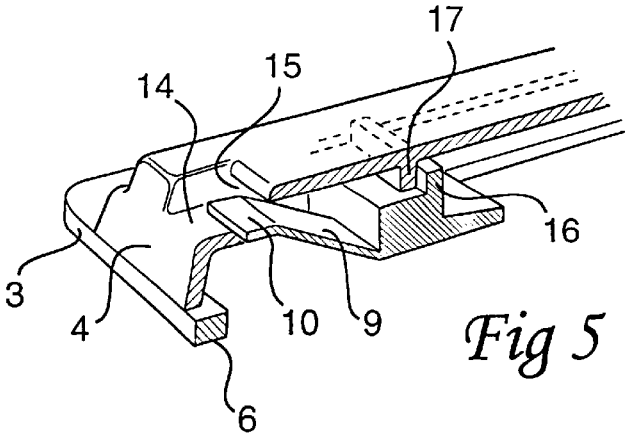
Fig 5

SAFETY DEVICE IN OPENING ARRANGEMENTS FOR PACKAGING CONTAINERS

TECHNICAL FIELD

The present invention relates to a safety device in an opening arrangement for packaging containers, the opening arrangement comprising two mutually moving parts, viz. one part fixedly connected to a packaging container wall and a part movably connected to this fixed part and located on the opposite side of the fixed part in relation to the wall and disposed, in conjunction with the opening of the packaging container, to be displaced between a first, closed position and a second, open position in which a pouring aperture provided in the fixed part is exposed.

BACKGROUND ART

Packaging containers of the single-use disposable type for beverages such as milk and juice are often manufactured from a flexible, laminated packaging material which consists of a central core, or carrier layer of fibrous material, e.g. paper, which is coated on either side with homogeneous layers of thermoplastic material, for example polyethylene. The packaging material may also include additional layers in order, for example, to improve the light or bacteria tightness properties of the material, e.g. aluminium foil (Alifoil). The thus formed packaging laminate is reformed using per se known packing and filling machines by folding and sealing into individual packaging containers filled with liquid contents. The packaging containers are provided with different types of opening arrangements which, in their simplest form, may consist of a printed opening indication, and which, in more sophisticated packaging containers, may consist of a prefabricated, e.g. thermoformed opening and re-closure arrangement which is placed over a prepared opening region in the packaging container.

In prior art packaging containers which are provided with separately manufactured opening arrangements, for example produced by injection moulding, these are placed over a prepared opening region in the wall of the packaging container. The opening region normally consists of a hole punched through the wall and covered with a separate, tear-off covering strip which is thermosealed to the container wall around the hole. The separately-manufactured opening and re-closure arrangement comprises a fixed part with a frame sealed around the hole and a moving part pivotally connected to the fixed part. The moving part is in the form of a lid which, by snap action, may be connected to the fixed part so that it will be possible to re-close the packaging container in liquid-tight fashion once it has been opened for the first time. An opening arrangement of this type is described in greater detail in, for example, European Patent Application 97919839.7, to which reference is made for further information.

From the consumer point of view, it may be seen as a disadvantage that, in the above-described prior art type of opening arrangement, the outer lid must first be opened and thereafter, in a separate operation, the tear-off strip located within the frame of the fixed part is to be torn off so that the contents of the packaging container will be accessible for pouring. A second, prior art type of opening arrangement (European Patent Specification 280.023) offers a solution according to which the packaging laminate is automatically penetrated on the opening of the opening and re-closure arrangement. This opening arrangement similarly includes a fixed part which is applied on the outside of a packaging container and includes an aperture which coincides with a prepared opening region in the wall of the packaging container. The prepared opening region comprises a thinner material layer, which, for example, has been realised in that one or more of the layers included in the original laminate has been removed in the opening region, or in that an aperture punched through the wall is covered with an additional layer of, for example, thin plastic. The opening arrangement further includes a moving part which is displaceably connected to the fixed part and capable of being moved between a forward position closing the packaging container and a rear position in which the packaging container is open. On displacement of the moving part from the forward to the rear position, the weakened portion of the packaging laminate is simultaneously torn off in that a projecting tearing device or plough penetrates through the packaging container wall and tears off the weakened portion thereof. It will thus hereby be possible for the consumer, employing but a single opening operation, to open the packaging container so that its contents may be poured out via the opening and re-closure arrangement. This may thereafter be re-closed in that the moving part is displaced from its rear to its forward position, i.e. the position which the moving part had assumed from the outset when the packaging container was still unopened. One drawback inherent in this type of opening arrangement is that the consumer has no visual, reliable indication as to whether the packaging container had previously been tampered with or opened. As the wish that the packaging container be simple to open in a single operation has been satisfied, the separate tear-off strip (which had previously been rendered visible and torn off manually when the packaging container was opened for the first time) is now dispensed with. No arrangement or method for making it visually apparent to the consumer that a re-closed packaging container of this type had previously been opened has hitherto been realised.

There is, thus, a general need within the packaging industry to realise an opening arrangement of the above-mentioned type which is simple to operate for the consumer and which requires no separate tearing off of a covering strip or the like, but which nevertheless affords a clear and reliable indication when the packaging container had previously been opened.

OBJECTS OF THE INVENTION

One object of the present invention is to realise a safety device in an opening arrangement for packaging containers, the safety device making it possible, in an opening and re-closure arrangement of simple, easily operated type, to realise a construction which reliably indicates whether the opening arrangement had previously been manoeuvred between the closed and open positions, i.e. whether the packaging container had previously been opened.

A further object of the present invention is to realise a safety device of the above-mentioned type which, without complicating the operation of the opening and re-closure arrangement, automatically gives a clear indication as soon as the moving part of the opening arrangement has left its original, closed position.

Still a further object of the present invention is to realise a safety device of the above-mentioned type which is suitable to employ in opening and re-closure arrangements of prior art type and which may readily be integrated therewith, without, to that end, complicating or impeding the function of the opening arrangements.

Yet a further object of the present invention is finally to realise a safety device of the above-mentioned type which, despite a simple and reliable design and construction, is difficult or impossible to manipulate without this fact being visually revealed by the consumer.

SOLUTION

These and other objects have been attained according to the present invention in that a safety device of the type described by way of introduction has been given the characterizing feature that both parts each include mutually cooperating means which, in the closed position of the opening arrangement, have a first mutual positional relationship and, in the open position of the opening arrangement, have a second, visually different and irreversible positional relationship.

Preferred embodiments of the safety device according to the present invention have further been given the characterizing features as set forth in the appended subclaims.

ADVANTAGES

In that the safety device according to the present invention includes mutually cooperating means which, when the moving part of the opening arrangement is displaced from the closed to the open position, change appearance in an irreversible and manifest manner, the consumer is automatically given a clear indication that the packaging container had previously been opened. The device does not complicate the operation of the opening arrangement for the consumer, and nor does it entail any complex reconstruction or major modification of the construction and appearance of the original opening arrangement.

BRIEF DESCRIPTION OF THE ACCOMPANYING DRAWINGS

One preferred embodiment of the safety device according to the present invention will now be described in greater detail hereinbelow, with particular reference to the accompanying, schematic Drawings which show only those parts and details indispensable to an understanding of the present invention. In the accompanying Drawings:

FIG. 1 shows, in perspective obliquely from above, a per se known packaging container with an opening arrangement including a safety device according to the present invention;

FIGS. 2 A, B and C show the safety device according to the present invention in the different positions it may assume on operating the opening arrangement;

FIGS. 3 A and B show, in two perspectives, the moving part of the opening arrangement;

FIGS. 4 A and B show, in two perspectives, the fixed part of the opening arrangement; and FIG. 5 shows, on a larger scale, a part of the opening arrangement with the safety device according to the present invention.

DESCRIPTION OF PREFERRED EMBODIMENT

A safety device according to the present invention is intended to be employed in packaging containers of the single-use disposable type which are typically employed for consumer packages containing milk, juice or other beverages. Packaging containers of this type are normally manufactured from a laminated paper/plastic material which, in addition to a central core layer of carrier material, e.g. fibre-based material, includes outer layers of thermoplastic material, e.g. polyethylene. The thermoplastic outer layers on the one hand render the material liquid-tight, and on the other hand make for a thermosealing of the material against itself so that the packaging container may be provided with liquid-tight sealing joints. A per se known packaging container 1 of this type is shown in FIG. 1. At the upper side of the packaging container 1, there is disposed an opening arrangement 2 which is prefabricated, e.g. by injection moulding of thermoplastic material, and sealed to the outside layer of the packaging container material by, for example, thermosealing. The opening arrangement 2 covers an invisible, prepared opening in the packaging material. Normally, the prepared opening region is formed as an attenuated portion of the packaging laminate, which, for instance may be realised in that the central core or carrier layer is removed in the pertinent region, whereafter the hole which occurs is covered with the aid of the two outer thermoplastic layers, or by means of a separate foil of plastic or other suitable material. This type of prepared opening region is described, for example, in European Patent Specification 280.023, to which reference is made for further information. This Patent Specification also describes an opening arrangement of the same main type as the present opening arrangement, i.e. an opening arrangement which, in conjunction with its being opened in one manner or another, penetrates the prepared opening region so that the contents of the packaging container will be accessible and may be poured out of the packaging container 1 via the opening arrangement 2.

The opening arrangement 2 provided with the safety device according to the present invention comprises, as is apparent from FIGS. 3 and 4, a fixed part 3 and a moving part 4 connectable thereto. In the illustrated embodiment, the two parts 3 and 4 are substantially rectangular, but it is also possible to give these parts a different configuration, e.g. substantially oblong or round configuration. The fixed part 3 (FIG. 4) thus forms a substantially rectangular, frame-like surround around a penetrated portion or pouring aperture 5 which is located substantially centrally in the fixed part 3. The underside of the fixed part 3 displays a planar sealing surface 6 which extends around the pouring aperture 5 and is intended to be sealed against the outside of the packaging container, as will be described in greater detail below. The fixed part 3 further has a forward end which is terminated by a pouring edge 7 which is intended to guide a stream of the contents flowing out of the pouring aperture 5. On either side of the pouring aperture 5, there extend two guides 8 in the longitudinal direction of the fixed part, the guides being formed for cooperation with the moving part 4 and making possible displacement thereof reciprocally in relation to the longitudinal direction of the fixed part 3. At the rear end of the fixed part 3, there is disposed a tongue-shaped projection 9 extending (rearwardly) in the longitudinal direction and which, for the greater part, extends substantially parallel with the sealing surface 6 of the fixed part 3. The projection 9 also includes an end portion 10 which is bent and angled in a direction towards the plane of the sealing surface 6. In the unloaded state, the projection 9 remains substantially parallel with the above-mentioned sealing surface because of the flexible properties of the material, e.g. polyethylene, of which the fixed part 3 is manufactured by injection moulding.

The moving part 4 illustrated in FIG. 3 is similarly substantially rectangular and elongate and includes, at its lower side, subsequently facing towards the fixed part 3, two grooves 11 which extend in the longitudinal direction of the moving part 4 substantially along both of its edges. The grooves 11 are designed for cooperation with the previously mentioned guides 8 located along both longitudinal edges of the fixed part 3. The grooves 11 and the guides 8 thus make it possible to bring together the fixed part 3 and the moving part 4 in such a manner that they are linked to one another but make for mutual displacement in the longitudinal direction of both parts. The moving part 4 further includes, at its side subsequently turned to face towards the fixed part 3, a tearing device or plough 12 which is pivotally connected to the front end of the moving part 4 and is designed to be able to come into contact with the packaging material, or more precisely its weakened opening region via the pouring aperture 5 in the fixed part 3. This will be explained in greater detail below. At the forward end of the moving part 4, there is further provided an operating surface 13 on the opposite side in relation to the plough 12, the operating surface being designed to make possible operation of the moving part 4, i.e. displacement thereof in the longitudinal direction in relation to the fixed part 3. At the opposite, rear end of the moving part 4, there is provided a recess 14 which forms a countersunk region including a slit 15 extending through the material of the moving part 4. The slit 15 extends preferably transversely of the direction of movement of the moving part 4 and is of a length which corresponds to the width of the end portion 10 of the projection 9. When the moving part 4 is mounted on the fixed part 3, the recess 14 and the slit 15 are located a slightly greater distance from the sealing surface of the fixed part 3 than the projection 9, since this is located in its natural position unaffected by external forces. However, it is possible, utilising the flexibility of the plastic material, to bend the projection 9 in a direction from the sealing surface 6 of the fixed part so that the end portion 10 of the projection 9 can be inserted into the recess 14 via the slit 15 (FIG. 5), as will be described in greater detail below. It will further be apparent from FIG. 5 how the two parts 3 and 4 include a heel 16 in order to restrict the length of the relative movement, the heel being connected to the fixed part 3 and supporting the projection 9, as well as an arrest edge 17 cooperating with the heel, the edge extending transversely across the underside of the moving part 4 a slight distance from its rear end.

When the fixed part 3 and the moving part 4 are to be brought together into a unit, the parts are placed in position above one another and are pressed together, which, because of the flexibility of the material, makes it possible for the guides 8 to snap into the grooves 11 so that the cohesive unit is formed. By joining together the two parts 3 and 4 with the aid of the guides 8 and the grooves 11, the moving part may be displaced in the longitudinal direction of the unit from a closed position (FIG. 2A and rearwards (FIG. 2B) to an open position in which the forward end or edge of the moving part 4 is displaced so far rearwards that the pouring aperture 5 is more or less exposed. During this displacement of the moving part 4 rearwards, the plough 12 will, via the broader forward end of the pouring aperture 5, be displaced with the incisive plough end 12 under the sealing surface 6 of the fixed part 3, which implies, given that the fixed part 3 is, via the sealing surface 6, connected to the packaging material at the upper side of the packaging container 1, that the plough will cut through the packaging material—or more precisely the weakened opening region located under the opening arrangement 2—so that the material within this region is penetrated and displaced rearwards in relation to the pouring aperture 5 which is thus placed in communication with the interior of the packaging container 2 and makes for pouring of the contents of the packaging container via the pouring aperture 5, over the pouring edge 7 and further in a compact jet into, for example, a beaker or a glass. This function is per se well known in the art and is also essentially described in previously mentioned European Patent Specification 280.023, to which reference is made for further information.

The safety device in the described opening arrangement is activated on assembly of the fixed part 3 and the moving part 4 in that the projection 9 is pressed, against the resilient action of the flexibility of the material, in a direction from the sealing surface 6 of the fixed part 3 until such time as the end portion 10 of the projection 9 abuts against the underside of the moving part 4. By thereafter displacing the moving part somewhat forwards in relation to the fixed part 3, the end portion 10 of the projection 9 will, via the slit 15 be placed in the recess 14 so that it abuts against its surface and will be visible from the upper side of the opening arrangement in the from of a plate located in the recess 14 which preferably is of a colour deviating from that of the moving part 4. FIG. 2A shows this appearance from the upper side of the packaging container (the moving part 4 of the opening arrangement is partly transparent for purposes of clarity) when the opening arrangement 2 is located in the closed position, i.e., in the position it assumes when the packaging container is unopened and the weakened opening region is thus unbroken. When the consumer, for opening the packaging container, displaces the moving part 4 of the opening arrangement 2 rearwardly in relation to the fixed part 3 (FIG. 2B), the end portion 10 of the projection 9 will slide out of the slit 15 and spring downwards towards the packaging container or the sealing surface 6 of the fixed part 3. Hereby, an immediate indication is given to the consumer that the opening arrangement has been manipulated (i.e. displaced from its original, closed position) in that the end portion 10 is no longer visible in the recess 14. On reclosure of the opening arrangement 2, the moving part 4 returns to its original position. However, since the projection 9, because of the flexibility of the material, now once again extends substantially parallel with the sealing surface 6 of the fixed part 3, the end portion 10 of the projection 9 cannot re-slide into the recess 14 via the slit 15. Hence, the end portion 10 will not be visible in the recess 14 and the consumer has been given a reliable indication that the opening arrangement is now located in a re-closed position (FIG. 2C), i.e. the opening region of the packaging container has been penetrated and the contents of the packaging container can no longer be guaranteed. By providing, as was mentioned above, the surface in the recess 14 and/or the end portion of the projection 9 with mutually clearly contrasting colours, a manifest visual indication is given which is simple to read for the consumer. Since the fixed part 3 is sealed against the upper side of the packaging container along the entire sealing surface 6, it will not be possible to get at and manipulate the projection 9 from the outside, e.g. in an attempt to return it into the recess 14.

Naturally, it is also possible to modify the embodiment according to the present invention in a plurality of different ways. It is, for example, possible to provide the projection 9 with an end portion which, by means of an indication of rupture, is separate and discrete from the major portion of the projection 9 and which moreover is of a dimension which is larger than the free space in the slit 15. Hereby, the end portion 10 will, in conjunction with the opening of the opening arrangement 2, be torn off from the remaining part of the projection 9 and thereby fall off, which further renders unauthorised manipulation of the device according to the present invention even more difficult. The safety device according to the present invention may further be employed in other types of opening arrangements, for example substantially round opening arrangements of the twisting type.

Hereby, the mutual orientation and placing of the projection 9 and the recess 14 will naturally be adapted to the pertinent, arcuate opening movement, but this should most likely be possible to achieve without departing from the scope of the present invention as this is defined by the appended Claims. Thus, the safety device according to the present invention makes it possible, in a simple and reliable manner, to indicate to the consumer whether the opening arrangement has previously been opened or otherwise tampered with and manipulated. It is a particular advantage that this is realised as a function integrated in the opening arrangement, since it dispenses with complicated additional material in the form of, for instance, shrink film covering the opening arrangement, applied safety tapes, bands or the like. At the same time, the opening arrangement remains simple to operate for the consumer, since only one single opening manoeuvre is required.

What is claimed is:

1. A safety device in an opening arrangement for packaging containers, the opening arrangement comprising two mutually moving parts viz. one part fixedly connected to a packaging container wall and a part movably connected to this fixed part and located on the opposite side of the fixed part in relation to the wall and disposed, in conjunction with the opening of the packaging container, to be displaced between a first, closed position and a second, open position in which a pouring aperture provided in the fixed part is exposed, wherein both parts each include mutually cooperating means which, in the closed position of the opening arrangement, have a first mutual positional relationship and, in the open position of the opening arrangement, have a second, visually different and irreversible positional relationship, said means include, on the one hand, a projection connected to one part and, on the other hand, a recess provided in the other part, the projection in the closed position of the opening arrangement is at least partly located in the recess, wherein the projection is made of a flexible material and is positioned, in the closed position of the opening arrangement, in the recess against a force of flexibility.

2. The safety device as claimed in claim 1, wherein the recess includes a slit extending through one part.

3. The safety device as claimed in 2, wherein the slit extends at least partly transversely of the direction of movement of the moving part.

4. The safety device as claimed in claim 1, wherein the projection is connected to the fixed part and extends in the longitudinal direction thereof.

5. The safety device as claimed in claim 4, wherein the projection is in the form of a tongue, which through the elasticity of the material, strives in a direction from the moving part.

6. The safety device as claimed in claim 1, wherein at least the outer end portion of the projection cooperating with the recess in the closed position of the opening arrangement visually differs from adjacent portions of the moving part.

7. The safety device as claimed in claim 6, wherein the outer end portion of the projection is of a deviating color.

8. The safety device as claimed in claim 7, wherein the outer end portion of the projection in the closed position of the opening arrangement covers a surface of a deviating color.

9. An opening arrangement in a packaging container, comprising:

first and second parts;

the first part being fixedly connected to a wall of the packaging container, the second part being movably connected to said first part and located on the opposite side of the fixed part in relation to the wall;

the second movable part being displaceable between a first, closed position and a second, open position in which a pouring aperture provided in the fixed part is exposed; and a tamper indicating element which remains attached to the opening arrangement when the packaging container is opened, said tamper indicating element including a tongue made of a flexible material which, when the packaging container has not yet been opened, is originally positioned in the recess of the first part against a force of flexibility, said tongue being visible from an exterior of the packaging container when in the original, untampered position, wherein upon displacing the moving part with respect to the fixed part, said tongue springing downwards thereby preventing the tongue from being reinserted into said recess.

* * * * *